US006613420B1

(12) United States Patent
Leupolz et al.

(10) Patent No.: US 6,613,420 B1
(45) Date of Patent: Sep. 2, 2003

(54) INFRARED CAMOUFLAGE DEVICE

(75) Inventors: Andreas Leupolz, Horgenzell (DE); Werner Scherber, Bermatingen (DE); Walter Rothmund, Maxhuette-Haidhof (DE)

(73) Assignee: Dornier GmbH, Friedrichshafen (DE)

( * ) Notice: Subject to any disclaimer, the term of this patent is extended or adjusted under 35 U.S.C. 154(b) by 45 days.

(21) Appl. No.: 09/715,259

(22) Filed: Nov. 20, 2000

(30) Foreign Application Priority Data

Nov. 19, 1999 (DE) ..... 199 55 608

(51) Int. Cl.[7] ..... B32B 7/02
(52) U.S. Cl. ..... 428/212; 428/919
(58) Field of Search ..... 428/212, 213, 428/167, 919; 114/15

(56) References Cited

U.S. PATENT DOCUMENTS

| | | | | |
|---|---|---|---|---|
| 2,355,008 A | * | 8/1944 | Moran | 428/919 |
| 4,021,131 A | * | 5/1977 | Bakken et al. | 428/919 |
| 5,281,460 A | | 1/1994 | Cox | |

FOREIGN PATENT DOCUMENTS

| | | |
|---|---|---|
| EP | 0633447 | 1/1995 |
| GB | 2274154 | 7/1994 |

* cited by examiner

*Primary Examiner*—Donald J. Loney
(74) *Attorney, Agent, or Firm*—Crowell & Moring LLP

(57) ABSTRACT

An infrared camouflage device has a surface structure having two groups of partial areas. Partial areas in the first group are directed downward and form an angle α of between 5° and 45° with vertical; and partial areas in the second group are directed upward and form an angle β of between 50° and 65° with vertical; and α+β<90°.

15 Claims, 2 Drawing Sheets

INFRARED CAMOUFLAGE DEVICE

This application is related to U.S. patent application Ser. No. 09/715,260 filed on Nov. 20, 2000.

BACKGROUND AND SUMMARY OF THE INVENTION

This application claims the priority of German patent document 199 55 608.3, filed Nov. 19, 1999, the disclosure of which is expressly incorporated by reference herein.

The invention relates to an infrared (IR) camouflage device for land targets, especially suitable for camouflaging military objects, such as land vehicles, against thermal imaging devices and infrared guidance heads.

In thermal camouflage an attempt is made to adjust the heat radiation emitted by an object to be camouflaged to the level of the thermal background; that is, to influence the temperature of the observable surfaces by design measures, such as heat damping, isolation, and back ventilation. While improvements are known in the area of active signature (for example for internal heat sources, such as motor, drives, energy assemblies), no satisfactory solutions have been provided by these measures relative to solar (passive) heat signature, since the temperature response of military objects as a rule differs sharply from that of a natural background. Proposed solutions for compensating for these deviations by active heating or cooling are described for example in German patent document DE 32 17 977 A1 and are less practical, especially in view of their high energy consumption.

Other known techniques are aimed at achieving signature reduction, not by influencing the actual surface temperature, but by changing the emission behavior of the surface. It is known that heat radiation of a body is determined not only by its temperature but also by the thermal emissivity $\epsilon$ of its surface. The use of low emission surface layers for infrared camouflage is known, and is described for example in German patent document DE 30 43 381 A1 and European patent document EP 0 123 660 A. One problem with this type of camouflage with low emission camouflage agents is that when the thermal emissivity $\epsilon$ is reduced, the infrared reflectivity $\rho$ theoretically rises according to the formula $\rho=1-\epsilon$. Hence, an increased reflection of ambient radiation takes place. This overlaps the natural emission so that the heat radiation (and therefore the observable radiation temperature when the thermal emissivity is reduced) depends to an increasing degree on the temperatures of the reflected ambient areas (ground temperature, sky temperature). Reflections from areas of the sky close to the zenith have proven to be especially critical since their radiation temperatures differ considerably, depending on the cloud cover, and can also heavily influence the signature. A known effect of low emission camouflage means is the observation of "cold spots", i.e., areas with a low radiation temperature compared with the background temperatures due to the reflection of cold areas of the sky.

In order to take this fact into account, European patent document EP 0 250 742 A1 discloses a device with which thermal emissivity can be controlled. The heat radiated from an object is adjusted within wide limits as desired with very slight energy demand by controlling the shares of heat reflection and emission. A substantial reduction of contrast of the thermal radiation relative to the background is possible. However, the high cost of making such systems and the necessity for additional measurement and regulating devices are disadvantages.

When using low emission infrared camouflage means, the geometric features of the object to be concealed have to be taken into account. Distinctions must be made in particular between:

- Surfaces Areas inclined toward the ground
- Surfaces that are horizontal oriented or inclined toward the sky
- Surfaces that are vertical oriented or slightly inclined toward the sky (up to 25° relative to vertical).

Basically, these areas require different embodiments of camouflaging means. For areas that are predominantly inclined to the ground, the known low emission camouflage agents with a permanent thermal emissivity that is as low as possible are used, since the ground temperatures located in front of the object will be reflected, independently of the observation point. The radiation temperature of the ground is generally identical to the rest of the thermal background. By transferring this temperature to the object to be camouflaged, a high reduction of contrast can be achieved with a corresponding camouflage effect. In this case, known LE (low emission) camouflaging agents can be used, such as for example, low emission paint ("LEP") or low emission polymer foil ("LEF").

For areas with predominantly horizontal alignment the known low emission camouflage agents cannot be used directly. The problem is that these areas, if they can be seen, always reflect predominantly sky temperatures near the zenith. Because these sky temperatures are very low, and can vary considerably depending on the cloud cover, reflected heat radiation is extremely dependent on the cloud cover. In many cases, horizontal areas that are provided with low emission camouflage means will be "cold spots" when, by reflection of the cold sky, the natural emission is overcompensated. Low emission behavior is desired only to the extent that increasing solar heating of the surface necessitates a reduction of the thermal radiation.

Similar problems exist in areas that are directed upward (angle to the horizontal less than 65°). They can reflect the sky radiation as well.

The situation in camouflage of essentially vertical surfaces (this includes surfaces inclined slightly to the sky—up to 25° relative to the vertical) is a mixture of the already-described conditions in the horizontal or the upwardly directed areas on the one hand and areas inclined to the ground on the other. Depending on the observation angle, the heat radiation reflected at the camouflage agent comes primarily from areas near the ground or from the sky radiation. The problem is that even small changes in the observation angle (or equivalently, small changes in inclination of the area, for example with moved camouflaged objects) can cause a sharp change in the radiation temperature of the object.

Hence, the object of the invention is to provide an effective camouflage device for object surfaces that are aligned essentially vertical without costly measurement and regulating devices.

Another object of the invention is to provide a camouflage arrangement in which the percentage of the reflected radiation that comes from sky radiation or ground radiation remains constant over a range of angles of inclination which is as large as possible.

These and other objects and advantages are achieved by the camouflage arrangement according to the invention, which breaks up the surface into areas inclined to the ground and areas inclined to the sky, with an area as large as possible of the radiation reflected at the camouflage device coming from the ground and the smallest percentage being reflected from the sky radiation or from only warmer sky areas near the horizon. This can be accomplished according to the invention by a surface structure that consists exclusively of two groups of partial areas, with the partial areas of the first group being directed downward and forming angles $\alpha$ between 5° and 45° with the vertical and the partial areas in the second group being aligned upward and forming angles $\beta$ between 50° and 85° with the vertical, with $\alpha+\beta$ being <90°. The partial areas within each group can have different angles $\alpha$ and $\beta$.

The total surface of all the upwardly aligned partial areas is advantageously less than the total area of all of the downwardly directed partial areas, and the structural sizes of the surface structure lie especially between 12 $\mu$m and 1 cm, preferably between 100 $\mu$m and 1 mm.

The structural sizes are chosen in an especially advantageous embodiment so that they are larger than the wavelength of infrared radiation and smaller than the wavelength of radar radiation. A size range suitable for the purpose is that between 20 $\mu$m and 1 mm. This ensures that the radar radiation cross section will not be influenced negatively by the structure according to the invention.

To maintain the visual camouflage effect an IR-transparent cover layer (for example a pigmented and matted polyethylene foil) can be provided as an outer covering for the camouflage device in the direction of the observer.

Additional camouflage effects using the principle of spot camouflage paint can be achieved in which, even in the infrared, contour breakup is introduced. This can be produced very effectively by different thicknesses of the colored cover layer on top. Therefore, at all temperature states of the system, the infrared signature is superimposed by a spot-type pattern.

Advantageously, the downwardly directed partial areas that reflect the ground components are made of a material with a thermal emissivity that is as low as possible, i.e., maximum infrared reflectivity. (Typical values for this are $\epsilon \leqq 0.5$.) The upwardly directed partial areas that reflect the sky radiation, on the other hand, can be made of a material with a high degree of infrared emission (especially $\epsilon \leqq 0.8$, for example $\epsilon \leqq 0.9$) so that the reflection of sky radiation can be suppressed.

The camouflage device according to the invention requires no additional control elements such as sensors, actuators, electronics, or cables. In addition, exact locally resolved determination of the surface temperature, which is present once the camouflage effect referred to at the outset according to the prior art for adjusting the thermal emissivity for each actively controllable IR camouflage element, is abent.

Further advantages of the device according to the invention are:

- High IR camouflage efficiency is achieved for different objects;
- The camouflage device according to the invention can be made in the form of sturdy, inexpensive elements;
- Additional visual camouflage is possible in any desired color.

Other objects, advantages and novel features of the present invention will become apparent from the following detailed description of the invention when considered in conjunction with the accompanying drawings.

DETAILED DESCRIPTION OF THE DRAWINGS

Figure 1:
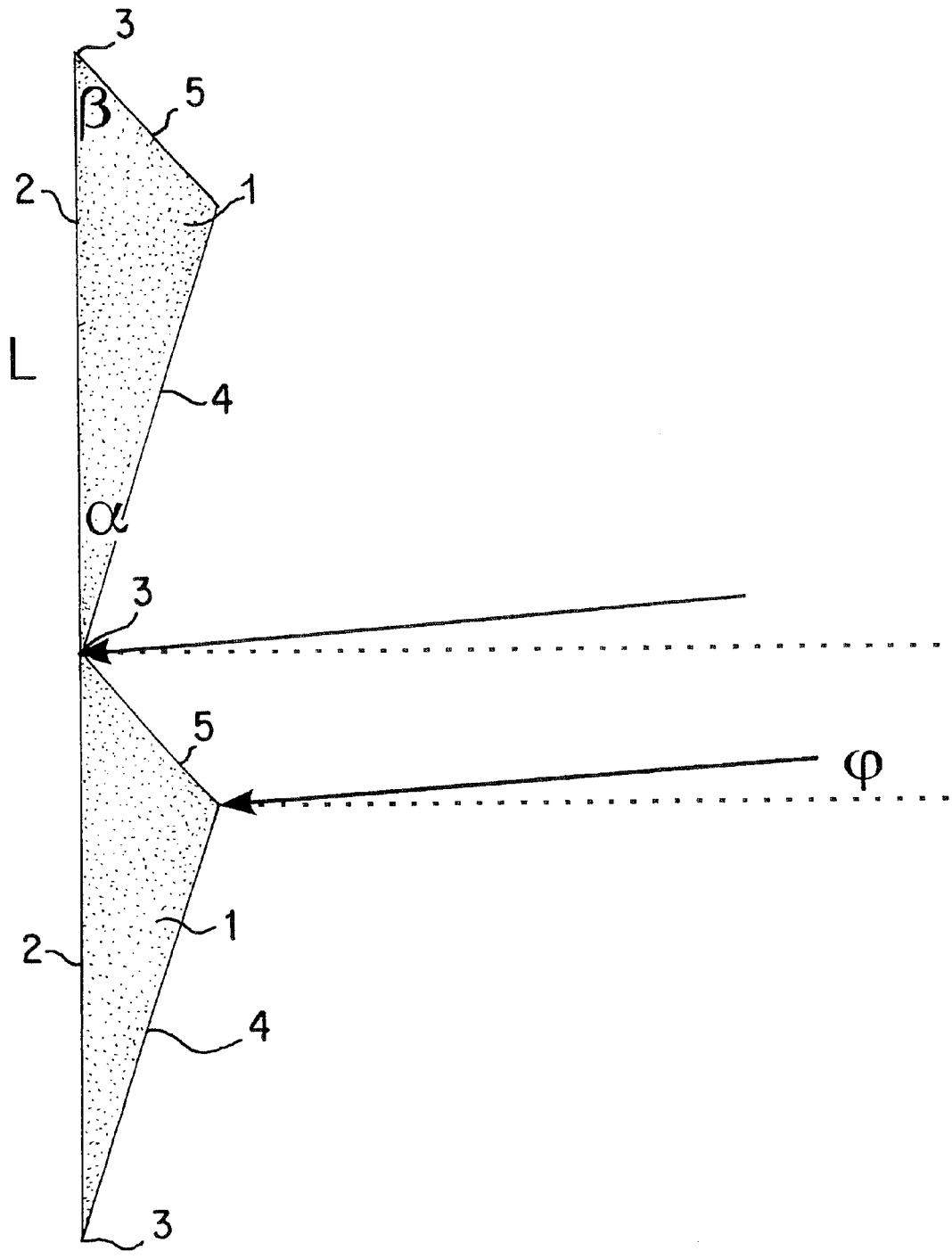
FIG. 1 shows an embodiment of the camouflage device according to the invention.

FIG. 1 shows an embodiment of a surface structure according to the invention. It consists of a regular sequence of elevations 1 with triangular cross sections whose hypotenuses 2 (length L) are directed essentially vertically. There is a groove structure with horizontally aligned asymmetric grooves 3. The geometry of the structure is established by the angles $\alpha$ and $\beta$ and by the structural size L. The angle $\phi$ is the viewing angle of an observer to the horizontal. Suitable value ranges for the angles $\alpha$,$\beta$ are:

$\alpha$: 5–45° (preferably 15–25°);

$\beta$: 50–85° (preferably 55–70°).

Figure 2:
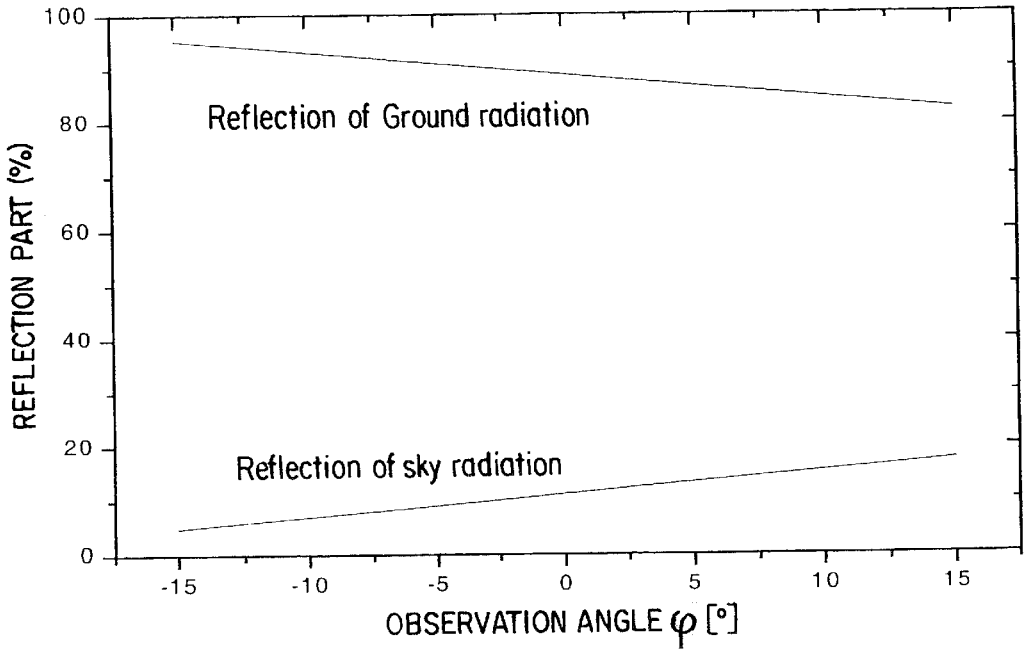
FIG. 2 is a graphic representation of the portions of the radiation reflected on the camouflage device shown in FIG. 1 used for sky radiation or for ground radiation, depending on the observation direction.

Taking the reflectivity of the two observable partial surfaces at different angles $\phi$ into account, it is possible to determine the percentages that are obtained with different angles $\alpha$ and $\beta$ of the structure. FIG. 2 shows the percentile amounts of the radiation reflected from the ground or the sky at different observation angles $\phi$ for an especially favorable geometry with $\alpha$=15° and $\beta$=65°. As can be seen, the amounts reflected over a large angle area that come from the sky or from the ground are approximately constant while the ground component is very high as desired.

For maximum efficiency, the larger, downwardly directed partial area 4, which reflects the parts near the ground is set with a layer with the lowest possible thermal emissivity, i.e., maximum IR reflectivity. The upwardly directed partial areas 5 which reflect the sky radiation can be made from a material with a high thermal emissivity so that any reflection from the sky can be suppressed.

Figure 3:
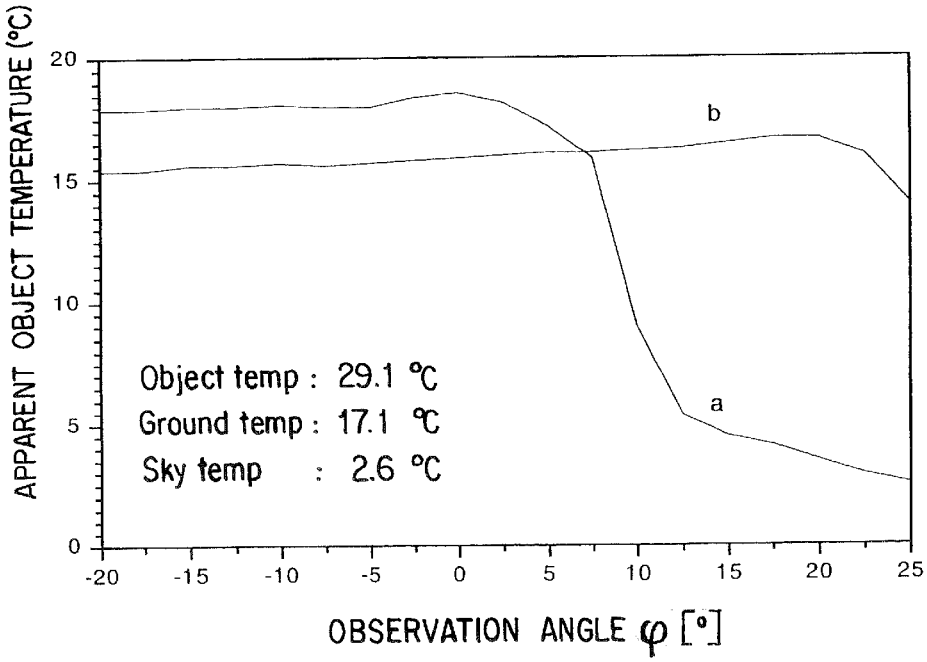
FIG. 3 shows the apparent object temperature as a function of the observation direction when using the camouflage device according to the invention (curve b) by comparison with known camouflage device (curve a).

FIG. 3 shows the radiation temperature of two areas with the same thermal emissivity which was measured at different observation angles $\phi$ with curve a representing the measured values of an unstructured surface and curve marked b showing the measured values of a structure according to the invention. It is evident that the radiation temperatures of the unstructured sample drops sharply beyond a certain angle, as a result of reflection of a cold sky surface, while the structured sample in the same radiation environment shows practically no such angle dependence.

The (micro)-structuring according to the invention can be produced by various conventional methods depending on the size of the structure such as embossing, milling, etching, or photolithographic methods. An appropriately structured tool can be used for example to transfer the structure to a preferably self-adhesive plastic foil, for example by hot embossing in a calendar. High IR reflection is produced by metallization followed by an IR-transparent color-producing cover layer. Another possibility consists in painting the structure with low emission camouflage paint.

With very small structural sizes (L approx. 100 $\mu$m), it is also possible to use colored plastic foils made of IR-transparent materials (for example polyolefins such as PE, PP) by hot embossing with the structure and to apply the IR reflector by metallizing the back. The structuring in this case additionally causes the necessary matting to reduce the visual shine of the plastic foil.

A total system for camouflaging an object using the camouflaging device according to the invention therefore has the following structure:

The downwardly directed areas 4 of the object to be camouflaged are covered with a material that has a low thermal emissivity. Typical values for this are $\epsilon \leqq 0.5$.

The upwardly directed areas 5 of the object to be camouflaged are provided with a material that has a high thermal emissivity (especially $\epsilon \leqq 0.8$).

On the perpendicular areas of the object to be camouflaged, (micro)-structuring causes the areas to be split up into partial areas that are directed upward and partial areas that are directed downward.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An infrared camouflage device comprising a surface structure that consists of first partial surface areas and second partial surface areas, wherein:

said first partial surface areas are directed downward and form an angle $\alpha$ between 5° and 45° relative to vertical;

said second partial surface areas are directed upward and form an angle $\beta$ between 50° and 85° relative to vertical;

$$\alpha+\beta<90°;$$

and the first partial surface areas are made of a first material which has a thermal emissivity that differs from a thermal emissivity of a second material from which the second partial surface areas are made, with the first material having a thermal emissivity that is lower than that of the second material.

2. The infrared camouflage device according to claim 1, wherein a structural dimension of the partial surface areas is between 12 $\mu$m and 1 cm.

3. The infrared camouflage device according to claim 1, wherein a structural dimension of the partial surface areas is between 100 $\mu$m and 1 mm.

4. The infrared camouflage device according to claim 1, wherein the aggregate total surface area of the second partial surface areas is smaller than the aggregate total surface area of the first partial surface areas.

5. The infrared camouflage device according to claim 1, wherein the surface structure has a groove structure with horizontally aligned asymmetrical grooves.

6. The infrared camouflage device according to claim 1, further comprising an outer cover made of an infrared-transparent pigmented and matted layer of plastic.

7. The infrared camouflage device according to claim 6, wherein said plastic is polyethylene.

8. The infrared camouflage device according to claim 6, wherein the cover layer has areas of different thickness.

9. A method for infrared camouflage of an object, comprising:

providing a surface of said object with a structure that consists of first partial surface areas and second partial surface areas, wherein said first partial surface areas are oriented downward and form an angle $\alpha$ between 5° and 45° relative to vertical;

said second partial surface areas are directed upward and form an angle $\beta$ between 50° and 85° relative to vertical;

$$\alpha+\beta<90°;$$

and wherein the first partial surface areas are made of a first material which has a thermal emissivity that differs from a thermal emissivity of a second material from which the second partial surface areas are made, with the first material having a thermal emissivity that is lower than that of the second material.

10. The infrared camouflage method according to claim 9, wherein the collective total area of the second partial surface areas is smaller than the collective total area of the second partial surface areas.

11. The infrared camouflage method according to claim 9, wherein the surface structure has a groove structure with horizontally aligned asymmetrical grooves.

12. The method according to claim 9, further comprising:

providing said object with an outer cover made of an infrared-transparent pigmented and matted layer of plastic material.

13. The infrared camouflage device according to claim 12, wherein the cover layer has areas of different thickness.

14. An infrared camouflage structure for covering a substantially vertically oriented surface of an object, said structure consisting of a plurality of spacially alternating first and second areas, wherein said first areas are directed downward and form an angle $\alpha$ between 5° and 45° relative to vertical;

said second areas are directed upward and form an angle $\beta$ between 50° and 85° relative to vertical;

$$\alpha+\beta<90°;$$

and the first areas are made of a first material which has a thermal emissivity that differs from a thermal emissivity of a second material from which the second partial surface areas are made, with the first material having a thermal emissivity that is lower than that of the second material.

15. An object having a substantially vertically oriented surface covered by an infrared camouflage structure that consists of a plurality of spacially alternating first and second areas, wherein said first areas are directed downward and form an angle $\alpha$ between 5° and 45° relative to vertical;

said second areas are directed upward and form an angle $\beta$ between 50° and 85° relative to vertical;

$$\alpha+\beta<90°;$$

and the first areas are made of a first material which has a thermal emissivity that differs from a thermal emissivity of a second material from which the second partial surface areas are made, with the first material having a thermal emissivity that is lower than that of the second material.

* * * * *